US005358220A

United States Patent [19]

Yu-Kuang

[11] Patent Number: 5,358,220

[45] Date of Patent: Oct. 25, 1994

[54] PLAYPEN FRAME STRUCTURE

[76] Inventor: Hsiung Yu-Kuang, No. 1-1, Hsi-Keng, Tsao Chiao Hsiang, Maio Li Hsien, Taiwan

[21] Appl. No.: 32,133

[22] Filed: Mar. 16, 1993

[51] Int. Cl.[5] ..... A47D 7/00

[52] U.S. Cl. ..... 256/25; 256/24; 5/99.1

[58] Field of Search ..... 256/24, 25, 26; 403/65, 403/83, 84, 93; 5/99.1, 102, 98.1, 98.3

[56] References Cited

U.S. PATENT DOCUMENTS 3,162,865 12/1964 Tigrett ..... 5/99.1

4,669,138 6/1987 Kassai ..... 5/99.1

4,811,437 3/1989 Dillner ..... 5/99.1

*Primary Examiner*—Randolph A. Reese

*Assistant Examiner*—Anthony Knight

*Attorney, Agent, or Firm*—Pro-Techtor International

[57] ABSTRACT

A playpen frame structure comprising a rectangular top rail frame supported by four upright legs. Each side of the top rail includes a joint in its center to allow the frame to collapse. A reinforcement structure is provided on the lower ends of the supporting legs comprising reinforcement bars extending diagonally from the lower ends of the legs and pivotally connected to a central member.

8 Claims, 7 Drawing Sheets

PLAYPEN FRAME STRUCTURE

FIELD OF THE INVENTION

The present invention relates generally to a playpen and in particular to an improved playpen frame structure.

BACKGROUND OF THE INVENTION

Playpens are space for safely taking care of young babies and there are lots of different designs of playpens available in the market. Some of the conventional playpens have a non-foldaway structure and thus occupying a great space when not in use. A foldaway playpen frame structure was developed to overcome the space problem. Such a foldaway playpen structure provides a saving in storage space when the playpen is not in use. Examples are Taiwan Patent Application Nos. 81208167 and 81208161. Both applications are filed under the name of the applicant of the present invention.

Conventional foladaway playpen frame structures comprise a collapsible top rail structure under which side legs are pivotally secured. In the playpen of Taiwan Patent Application No. 81208167, there is provided a reinforcement structure pivotally mounted between lower ends of the side legs to more securely hold the side legs in position. The problem of the reinforcement structure disclosed in the prior art Taiwanese patent is that once the reinforcement structure is accidently hit or struck, a sudden, undesired collapse of the playpen frame may occur. This may hurt the baby sitting therein.

In Taiwan Patent Application No. 81208161, a joint for connecting two bars in a collapsible manner to form a top rail is disclosed. The joint has a complicated and inefficient structure so that when folded, the playpen still occupies a large space. Further, manufacturing a frame with the prior art joint is expensive due to the complicated structure of the joint.

It is therefore desirable to provide a foldaway playpen frame structure which overcomes the deficiencies of the conventional playpen structures.

SUMMARY OF THE INVENTION

It is an object of the present invention to provide a foldaway playpen frame structure of which each of the top rail is constituted by two bars pivotally connected to a common joint member wherein leaf spring-like resilient members are provided to bias retaining pins to engage and hold the bar members in the expanded position and a release member is provided to release the engagement between the bar members and the retainer members.

It is another object of the present invention to provide a foldaway playpen frame structure which comprises a reinforcement structure constituted by four diagonally-extending bar members which pivotally jointed on a central joint to provide a support to the baby sitting in the playpen, the central joint comprising a releasable holding means to prevent the undesired collapse of the playpen frame.

To achieve the above-mentioned objects, there is provided a playpen frame structure comprises a rectangular top rail frame supported by four upright legs. The top rail frame comprises four rails, each constituted by two bar members pivotally connected to a mid-joint which allows the bar members to pivot about pins mounted on the mid-joint. Inside each of the bar member, a resilient V-shaped retainer which has two legs each with a retaining pin thereon to extend into holes formed the bar member and the mid-joint so as to retain the bar member on the mid-joint. A release member is provided to push the retaining pins into the bar members and thus breaking the engagement between the mid-joint and the bar members. There is also provided a reinforcement structure on the lower ends of the legs to hold the legs in position and thus avoid collapse of the legs due to the weight of the baby. The reinforcement structure comprises reinforcement bars respectively extending diagonally from the lower ends of the legs and pivotally connected on a central joint which is supported on the ground by an additional leg. A bar support member in the form of a ring fits over the additional leg. The support member has multiple support arms extending from the ring. The support member is rotatably mounted on the central joint so that the support arms contact and thus brace the reinforcement bars.

BRIEF DESCRIPTION OF THE DRAWINGS

The above and other objects and advantages of the present invention will be readily apparent from the following description of a preferred embodiment taken in connection with the accompanying drawings, wherein.

DETAILED DESCRIPTION OF THE PREFERRED EMBODIMENT

Figure 1:
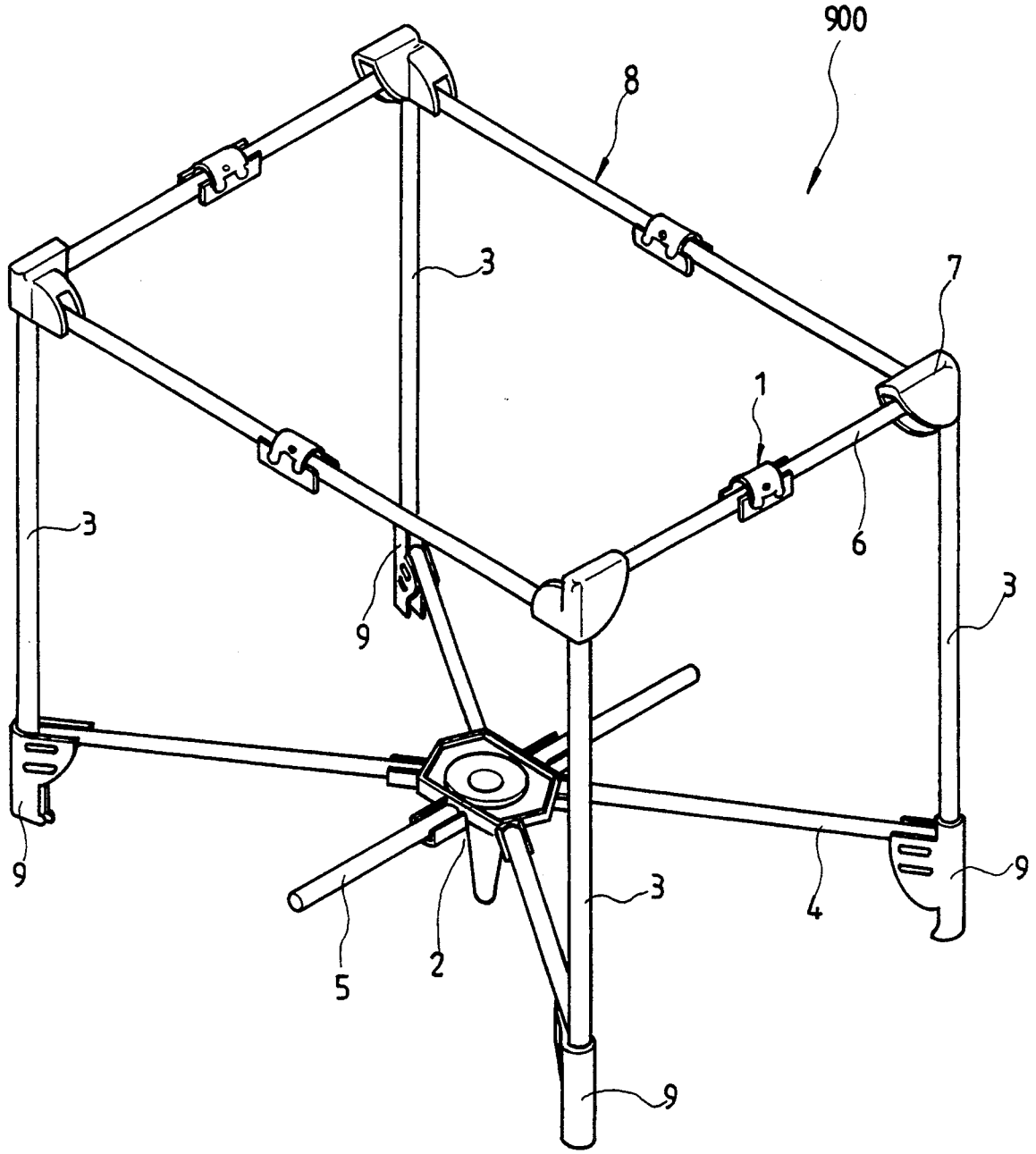
FIG. 1 is a perspective view showing a foldaway playpen frame structure made in accordance with the present invention, which is illustrated in an expanded condition.
Figure 2:
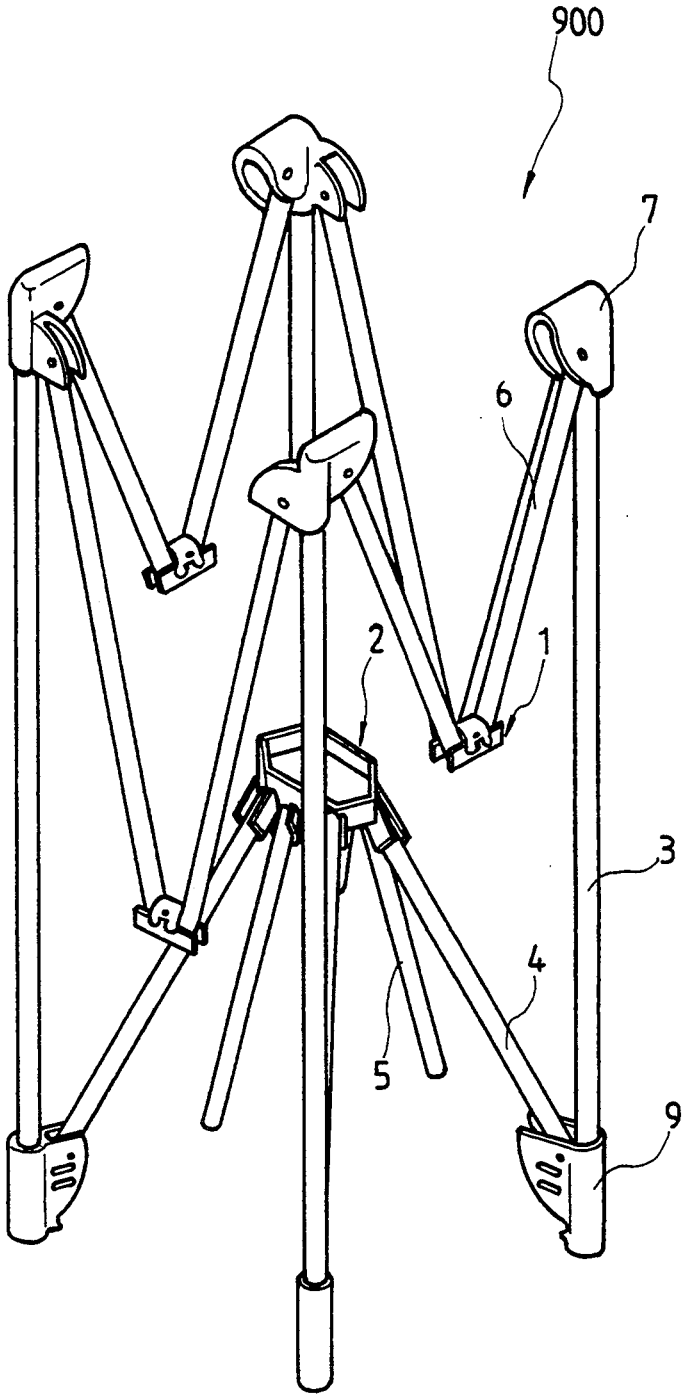
FIG. 2 is a perspective view showing the foldaway playpen frame structure of FIG. 1 in a folded condition.

With reference to the drawings and in particular to FIGS. 1 and 2, wherein a foldaway playpen frame structure, generally designated with reference numeral 900, is shown respectively in the expanded and folded conditions thereof, the playpen 900 comprises four top rails 8 defining, for example a rectangle, on the four corners of which four upright legs 3 are respectively mounted. Pivotally secured on the lower end of each of the legs 3 is a diagonally extending reinforcement bar 4 which is also pivotally connected to a central joint member 2 to form a diagonal reinforcement structure in order to maintain the legs 3 in a firm condition when the playpen is loaded.

Each of the top rails 8 is constituted by two bar members 6 pivoted to a mid-joint member 1 so that when the bar members 6 are expanded to aligned with each other under the guide of the mid-joint member 1, the top rail 8 is formed. Also, every two adjacent top rails 8 are pivotally connected on a corner joint 7 which constitutes a corner of the rectangle defined by the top rails 8 and to which the upper end of one of the legs 3 is pivotally secured to form the pivotal connection between the top rails and the legs.

On the lower end of each leg 3, a ground support member 9 is securely mounted to support the legs 3 on the ground and to provide the pivotal connection between the reinforcement bars 4 and the legs 3.

In the embodiment shown, the structure of the corner joints 7 and the ground support members 9 are known and not the features of the present invention so that no detail thereof will be further given herein.

The structure of the mid-joint members 1 of the illustrated embodiment, however, does possess improvement over the prior art and will be further discussed hereinafter with reference to FIGS. 3–5. After that, a description of the central joint member 2 will be given to illustrate another major feature of the instant invention.

Figure 3:
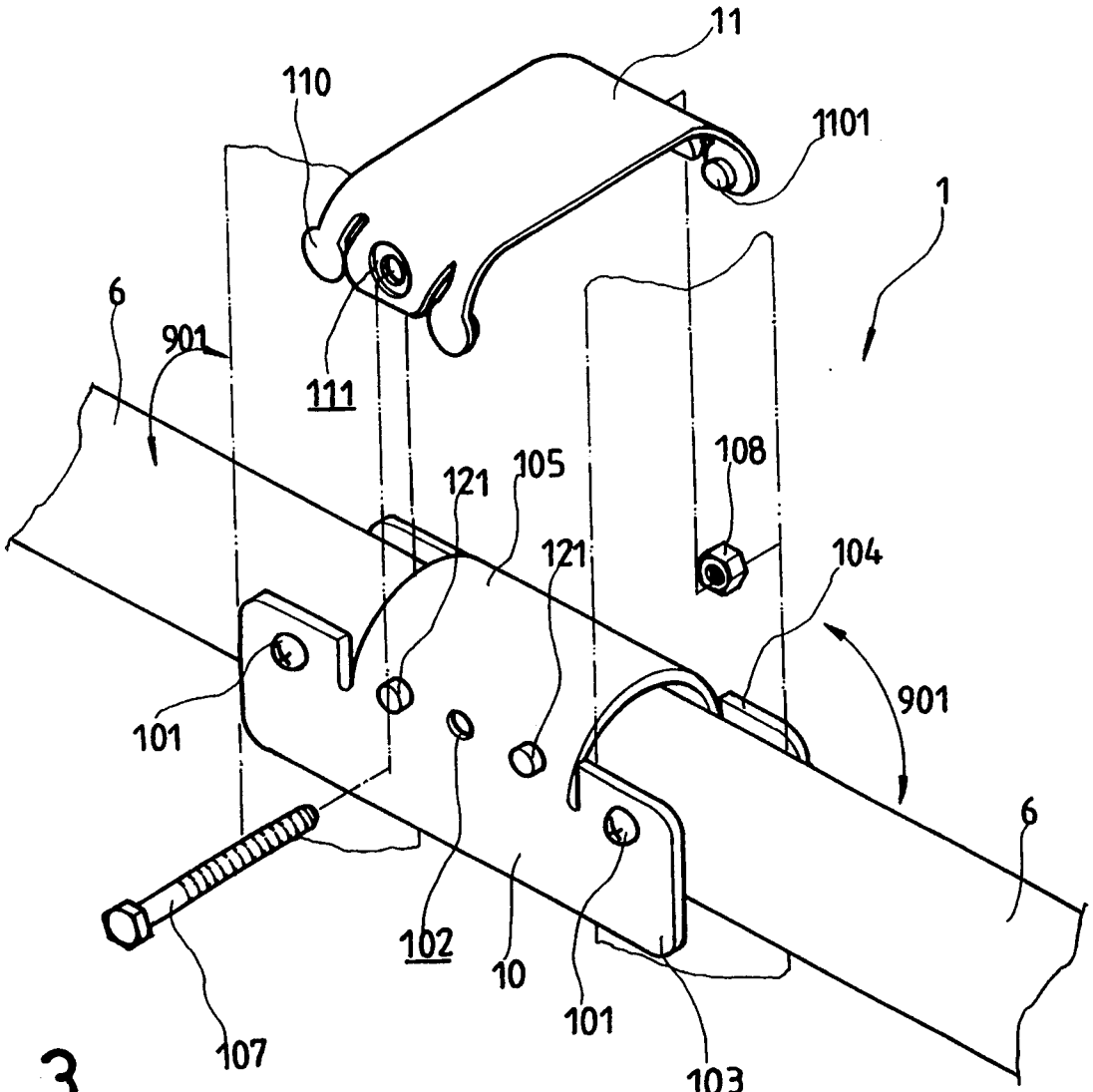
FIG. 3 is a partial perspective view, in a larger scale, showing in detail the structure of a mid-joint used in the playpen frame structure of FIGS. 1 and 2.
Figure 4:
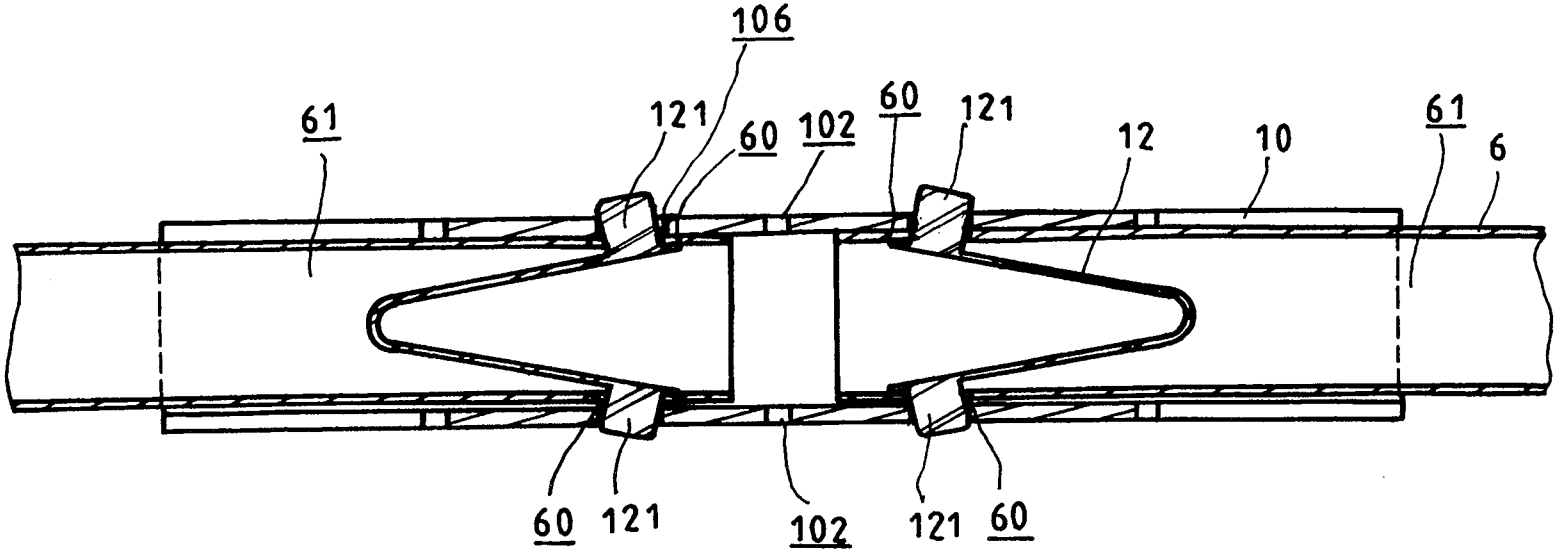
FIG. 4 is a longitudinal sectional view of the mid-joint shown in FIG. 3.
Figure 5:
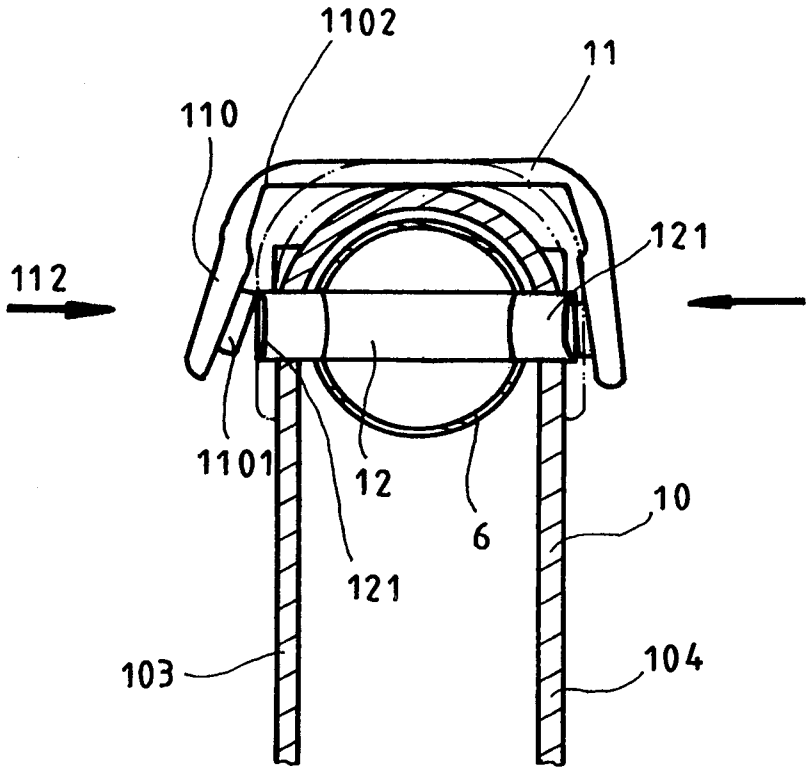
FIG. 5 is a cross sectional view of the mid-joint shown in FIG. 3.

With particular reference to FIGS. 3–5, wherein a mid-joint constructed in accordance with the present invention is shown, the mid-joint 1 comprises a joint body 10 which is constituted by two side plates 103 and 104, preferably substantially parallel with each other to define therein a space for receipt of the terminal portions of two bar members 6. The bar members 6 are each pivotally secured between the two side plates 103 and 104 of the joint body 10 by means of a pivot 101 so as to form a pivotal joint therebetween. Preferably, the side plates 103 and 104 are connected together by a connecting piece 105 which may assume partially straddling over the terminal portions of both bar members 6.

The mid-joint 1 further comprises two leaf spring-like resilient retainer members 12 each of which is substantially in the form of a V shape having two legs each with a retaining pin 121 thereon. The resilient retainer members 12 are respectively inserted into an interior space 61 formed on the terminal portion of each bar member 6 in such a manner that the retaining pins 121 are biased by the resilience thereof to be partially received within a slot 60 formed on the respective bar member 6 and are allowed to project out thereof. In correspondence to the holes 60 formed on the two bar members 6, there are four holes 106 formed on the joint body 10 to allow the retaining pins 121 to penetrate therethrough and thus retaining the bar members 6 in the expanded condition with respect to the joint body 10, as shown in FIG. 4.

To release the engagement between the retaining pins 121 and the joint body 10 and thus allowing the bar members 6 to rotate with respect to the joint body 10, along the direction of arrows 901 of FIG. 3, between the expanded position and the folded position, a release member 11 is provided which is preferably made of a sheet of resilient material.

The release member 11 may be secured on the joint body 10 by means of a bolt 107 extending through holes 111 formed on the release member 11 and holes 102 formed on the joint body 10 and tightened by a nut 108. The release member 11 has four flaps 110 each of which has an inward projection 1101 formed thereon. The inward projections 1101 have a size substantially the same as or slightly smaller than that of the retaining pins 121 and are provided in such locations to substantially align with the retaining pins 121 so that when external forces are applied on the flaps 110, as that indicated by arrows 112 of FIG. 5, the projections 1101 push the retaining pins 121 into the interior spaces 61, against the resilience of the retainer members 12, and thus disengaging the bar members 6 from the retainer members 12.

To allow the flaps 110 to approach the retaining pins 121 and thus allowing the inward projections 1101 thereof to disengage the bar members 6, it is preferable to provide a weaken portion 1102 on each of the flaps 110 (FIG. 5) which may serve as a rotatable connection between the flap 110 and the release member 11 so as to make the flap 110 easy to rotate with respect to the release member 11.

It should be noted that the release member 11 is not illustrated in FIG. 4 for the purpose of more clearly showing the engagement between the retainer members 12 and the bar members 6.

Figure 6:
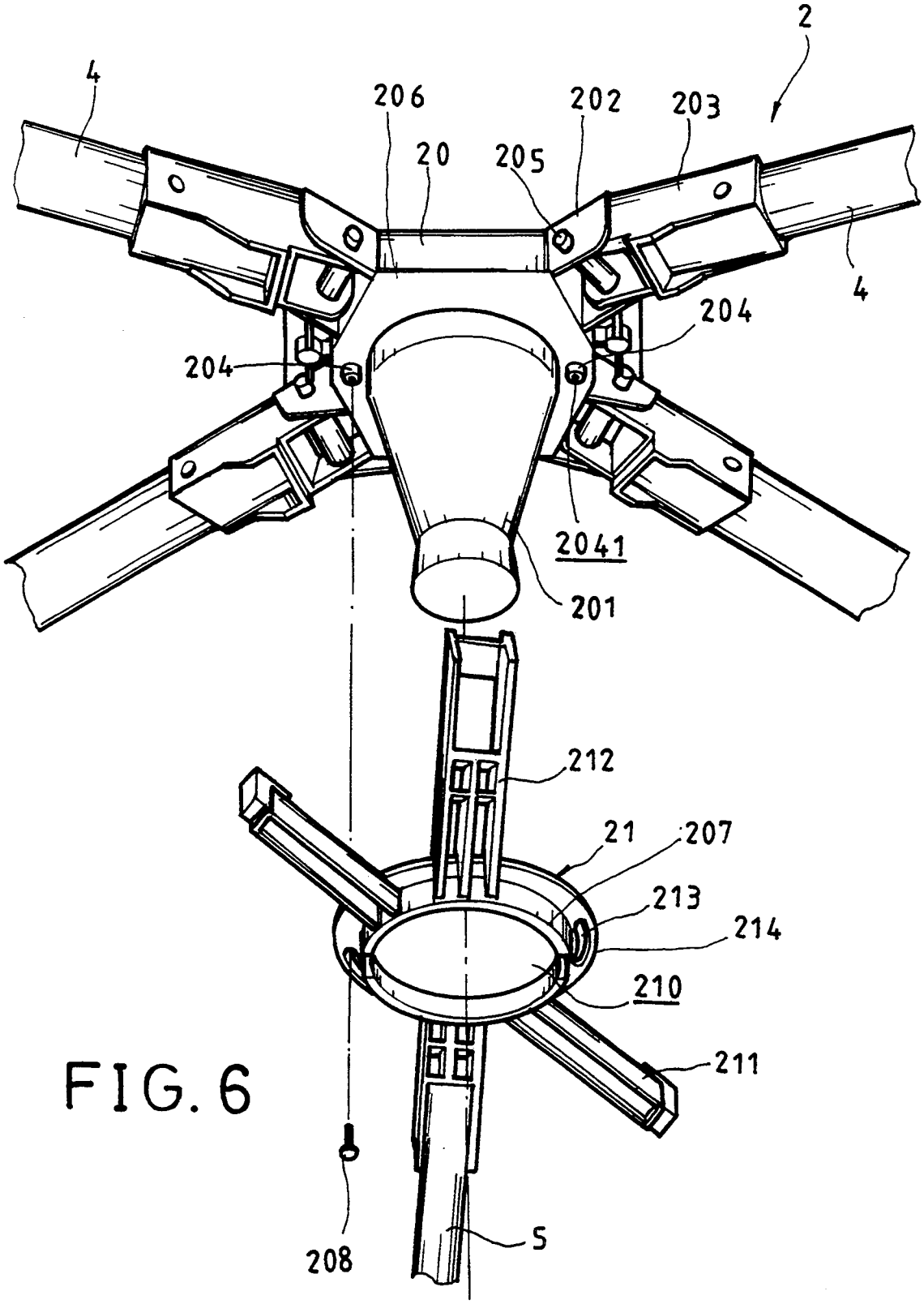
FIG. 6 is a partial perspective view, in a larger scale, showing in detail the structure of a central joint used in the playpen frame structure of FIGS. 1 and 2, viewed from the bottom side thereof.
Figure 7:
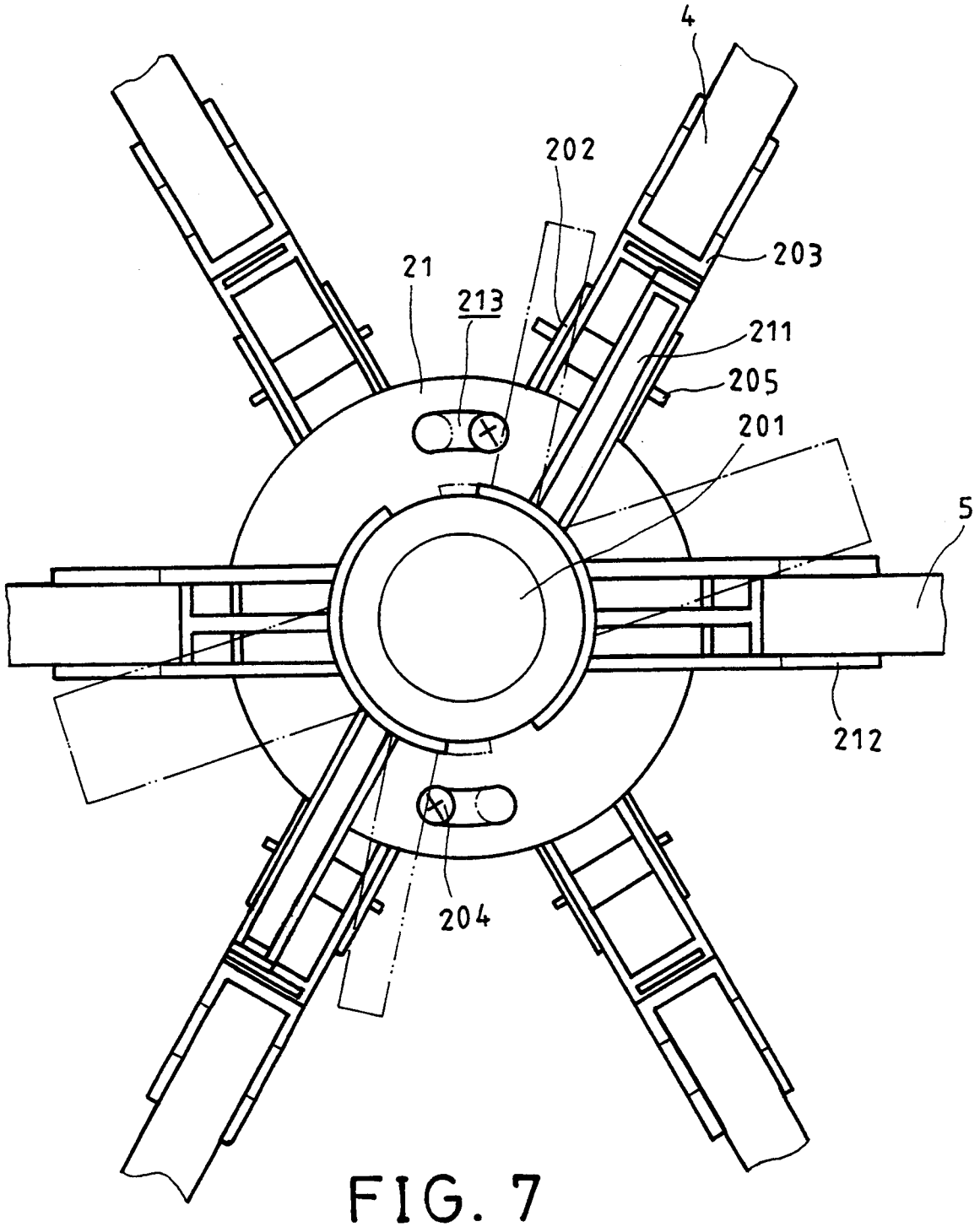
FIG. 7 is a bottom side plan view of the central joint of FIG. 6.

Turning back to FIGS. 1 and 2, the reinforcement bars 4 which are respectively connected between the ground support members 9 and the central joint member 2 serve as a reinforcement for the positioning of the legs 3 of the playpen. The structure of the central joint 2 is illustrated in detail in FIGS. 6 and 7.

The central joint 2 comprises a central joint body 20 on which four seats 202 are formed for respectively receiving therein and pivotally securing thereon a connector 203 by a pivot 205. Each of the connectors 203 in turn connects one of the reinforcement bars 4 so as to provide a pivotal connection between the reinforcement bar 4 and the central joint 2. The joint body 20 comprises a central leg 201 extending downward from an underside 206 thereof to support the central joint 2 on the ground.

A bar support member 21 which is in the form of a ring 214 having a central opening 210 to fit over the central leg 201 of the joint body 20 is provided to maintain the reinforcement structure in the expanded condition as that shown in FIG. 1. The bar support member 21 comprises a upright flange 207 formed along the periphery of the central opening 210 from which a plurality of support arms 211 extends which in the illustrated embodiment comprise two arms arranged in a substantially diametrically opposite manner to correspond to two opposite reinforcement bars 4. The support arms 211 have a length sufficient to contact the connectors 203 in order to prevent folding back of the reinforcement bars 4, as that shown in FIG. 7, and thus maintaining the reinforcement structure.

It is understood that although in the illustrated embodiment, two support arms 211 are provided, it is possible to use four support arms each corresponding to one of the reinforcement bars 4.

The ring 214 comprises at least one annular slot 213 concentrically formed thereon. The number of the annular slots 213 is two in the illustrated embodiment. Corresponding to the slots 213, there are provided dowel pins 204 on the underside 206 of the central joint body 20 to be respectively received within the annular slots 213. An inner-threaded hole 2041 is provided on each of the dowel pins 204 to threadedly engage with a screw 208 so as to retain the bar support member 21 on the underside 206 of the central joint 2.

The bar support member 21 is also provided with at least a seat 212 for removably connecting with an auxiliary reinforcement arm 5 to support the baby sitting in the playpen. The auxiliary reinforcement arm 5 also serves as a lever of force and with such a lever of force, a user can easily rotate the bar support member 21 with respect to the central joint 2 between the expanded position and the folded position.

In rotating the bar support member 21, the dowel pins 204 which extends into the annular slots 213 function as guiding means and the ends of the annular slots 213 function as stop means when abutting against the dowel pins 204. As can be observed in FIG. 7, when the bar support member 21 is positioned in the solid line position (the expanded position), the support arms 211 soundly support the respective reinforcement bars 4 in the expanded condition and when the bar support member 21 is rotated to have the support arms 211 and the seats 212 moved to the dashed line position (the folded position), the engagement between the reinforcement bars 4 and the support arms 211 is released to allow the reinforcement bars 4 to be folded back toward the central joint 2.

It is apparent that although the invention has been described in connection with the preferred embodiment, it is contemplated that those skilled in the art may make changes to certain features of the preferred embodiment without altering the basic concept of the invention and without departing from the spirit and scope of the invention as defined in the appended claims.

What is claimed is:

1. A playpen frame structure comprising:

a rectangular top rail structure which is defined by four top rails pivotally connected by four corner joints; and a leg structure which comprises four upright legs, each having an upper end and a lower end pivotally connected at the upper end thereof to the respective corner joint;

each of the top rails comprising two bar members which are pivotally connected to a common mid-joint, said mid-joint comprising as joint body having two side plates which are substantially parallel with each other and connected together at a portion thereof by a connecting piece to define a space for receiving a terminal portion of each of the two bar members, pivots being provided to secure the terminal portions of the bar members to the joint body to allow the bar members to rotate with respect to the joint body between an expanded position and a folded position, each of said bar members having an interior space in the terminal portion thereof to receive therein a leaf spring-like resilient retaining member which has two retaining pins each biased by the resilience thereof to project out through a hole formed on the bar member and to engage a hole formed on the joint body in order to retain the bar member with respect to the joint body;

a release member is provided to release the engagement between the bar members and the joint body to allow the joint body to be rotated from the expanded position to the folded position;

a reinforcement structure which comprises four reinforcement bars, each having a first end pivotally connected to the lower end of the respective upright leg and extending diagonally therefrom, and pivotally connected at a second end thereof to a central joint, said central joint comprising a central joint body on which four seats are formed for respectively receiving therein and pivotally securing thereon a connector by a pivot, each of the connectors in turn securely connecting the second end of the respective reinforcement bar to define the pivotal connection between the reinforcement bar and the central joint, said central joint body further comprising a central leg extending downward from an underside thereof to provide further support to said playpen frame; and a bar support member which is in the form of a ring having a central opening to fit over the central leg of said central joint body and movably secured thereon by securing means; the bar support member is used to maintain the reinforcement structure in an extended position, said bar support member having a plurality of support arms extending therefrom a distance sufficient to contact and thus brace the respective connectors.

2. A playpen frame structure as claimed in claim 1, wherein said release member comprising a sheet member having thereon four flaps each having an inward projection corresponding to one of the retaining pins of the resilient retainer members so that when external forces are applied on the flaps, the inward projections push the retaining pins, against the biasing resilience thereof, into the bar members to break the engagement therebetween.

3. A playpen frame structure as claimed in claim 2, wherein said sheet member is secured on said joint body by a bolt extending through both the sheet and the joint body.

4. A playpen frame structure as claimed in claim 2, wherein said sheet member comprises a weakened portion associated with each of said flaps to serve as a rotatable connection therebetween.

5. A playpen frame structure as claimed in claim 1 wherein said securing means comprises at least a dowel pin extending downward from the underside of said central joint body and having an inner-threaded hole for engaging a screw and a corresponding elongated annular slot to receive therein the dowel pin so as to support said bar support member on said central joint body by tightening said screw in said inner-threaded hole.

6. A playpen frame structure as claimed in claim 1 wherein said bar support member is rotatable about said central leg between a first position which is the expanded position where said support arms contact and hold the reinforcement bars in the expanded condition and a second position where said support arms disengage from and thus releasing said reinforcement bars.

7. A playpen frame structure as claimed in claim 1 wherein said bar support member further comprises at least a seat for removably securing therein an auxiliary reinforcement bar extending outward therefrom.

8. A playpen frame structure as claimed in claim 5 wherein said elongated annular slot has two ends respectively defining a first and a second stop and wherein said bar support member is rotatable about said central leg between a first and a second position respectively determined by said stops, said first position being the expanded position where said support arms contact and hold the reinforcement bars in the expanded condition and said second position being a position where said support arms disengage from and thus releasing said reinforcement bars.

* * * * *